US005125986A

United States Patent [19]

Kimura et al.

[11] Patent Number: 5,125,986

[45] Date of Patent: Jun. 30, 1992

[54] PROCESS FOR PREPARING TITANIUM AND TITANIUM ALLOY HAVING FINE ACICULAR MICROSTRUCTURE

[75] Inventors: Kinichi Kimura; Masayuki Hayashi; Mitsuo Ishii; Hirofumi Yoshimura, all of Hikari; Jinichi Takamura, Kawasaki, all of Japan

[73] Assignee: Nippon Steel Corporation, Tokyo, Japan

[21] Appl. No.: 629,828

[22] Filed: Dec. 19, 1990

[30] Foreign Application Priority Data

Dec. 22, 1989 [JP] Japan ..... 1-334236

[51] Int. Cl.[5] ..... C22F 1/00

[52] U.S. Cl. ..... 148/670; 148/691

[58] Field of Search ..... 148/11.5 F, 12.7 B, 148/133

[56] References Cited

U.S. PATENT DOCUMENTS

| | | | |
|---|---|---|---|
| 4,415,375 | 11/1983 | Lederich et al. | 148/11.5 F |
| 4,624,714 | 11/1986 | Smickley et al. | 148/11.5 F |
| 4,680,063 | 7/1987 | Vogt et al. | 148/133 |
| 4,820,360 | 4/1989 | Eylon et al. | 148/133 |
| 4,923,513 | 5/1990 | Ducheyne et al. | 420/420 |

FOREIGN PATENT DOCUMENTS 58-100663 6/1983 Japan .
61-253354 11/1986 Japan .

OTHER PUBLICATIONS

Proceeding of Titanium '80 Conference, May, 1980, pp. 2477-2481, "Hydrogen As An Alloying Element In Titanium" W. Kerr et al.

Trans., Indian Inst. Metals, vol. 37, No. 5, Oct. 1984, pp. 631-635, "Anisotropy Control Through The Use Of Hydrogen In Ti-6Al-4V", N.C. Birla et al.

Met. Trans. A., vol. 16A, Jun. 1985, pp. 1077-1987, "The Effect of Hydrogen As A Temporary Alloying Element On . . . Ti-6A-4V", W. Kerr.

*Primary Examiner*—Upendra Roy
*Attorney, Agent, or Firm*—Kenyon & Kenyon

[57] ABSTRACT

This present invention is characterized in that a titanium material on an $\alpha$ or $(\alpha+\beta)$ titanium alloy material hydrogenated in an amount of 0.02 to 2% by weight of hydrogen is heated to a temperature above the $\beta$ transformation point and below 1100° C., is hot worked in that temperature range at a reduction of 30% or more, the hot working is terminated in a $\beta$ single phase temperature region, and cooling to 400° C. or less, and annealing in vacuum are then carried out, whereby titanium and titanium alloy materials having a fine acicular microstructure are obtained.

6 Claims, 1 Drawing Sheet

( × 200 )

( × 200 )

( × 200 )

PROCESS FOR PREPARING TITANIUM AND TITANIUM ALLOY HAVING FINE ACICULAR MICROSTRUCTURE

BACKGROUND OF THE INVENTION

1. Field of the Invention

This present invention relates to a process for preparing titanium and αand (α+β) titanium alloy materials comprising a fine acicular microstructure and having a superior fracture toughness and fatigue properties.

2. Description of the Related Art

Titanium and titanium alloys are used in various of material applications, such as aerospace and structural components for automobiles, due to their high strength-to-density ratio and excellent corrosion resistance, and the applications thereof are increasing. The properties required of these materials in general are a good fracture toughness and high fatigue strength, and a structural material satisfying the above-described requirements must have a metallographically fine microstructure.

Titanium and titanium alloys are supplied in the form of plates, wires, rods, tubes or shapes and generally manufactured through a combination of hot working with heat treatment, but in the prior art processes, it is difficult to prepare a product having a homogeneously fine microstructure. Specifically, with respect to commercial pure titanium, since the impurity contents are limited, it is difficult to homogeneously refine the microstructure. On the other hand, the α and (α+β) titanium alloys have a drawback in that a proper working temperature range is too narrow to satisfy, during the hot working, both a requirement of a good workability for obtaining a very precise product shape and a requirement for forming a fine microstructure.

Examples of known processes for preparing the above-described alloys include that disclosed in Japanese Unexamined Patent Publication No. 58-100663, wherein a primary working is conducted in a β region having a good workability and a finish working is then conducted in an (α+β) region, and that disclosed in Japanese Patent Publication No. 63-4914, wherein the heating and working are repeated in a narrow temperature range in an (α+β) region, to thereby form a fine equiaxed grain microstructure.

In these processes, however, a high order working must be conducted in an (α+β) region wherein the hot workability is poor, and thus the productivity is very poor due to the occurrence of hot tear cracking, etc. Further, the resultant microstructure is not sufficiently refined. For this reason, in some cases, as specified in AMS4935E, the finish working is conducted in a β region wherein the working can be easily conducted. In this case also, since the working is conducted in a β region at ahigh temperature, not only does the β grain per se grow to a large size, but also it is difficult to prepare a desired fine acicular microstructure even when quenching is subsequently conducted.

Specifically, in titanium and existing α and (α+β) titanium alloys, since the β transformation point is high (for example, about 885° C. for JIS grade 2 titanium, about 1040° C. for α Ti-5Al-2.5Sn, and about 990° C. for (α+β) Ti-6Al-4V), the β phase per se is coarsened. Further, since the Ms point is high (for example, about 850° C. for JIS grade 2 titanium, about 950° C. for α Ti-5Al-2.5Sn, and about 850° C. for (α+β) Ti-Ti-6Al-4V) an acicular martensitic phase is decomposed into an (α+β) phase during cooling from the β region temperature. Therefore, the material prepared according to the conventional process comprises a mixed structure composed of a coarse lamellar α phase formed from a coarsened β phase, and a residual β phase. This material is disadvantageously inferior to a material having a fine microstructure, from the viewpoint of such properties as the fatigue strength, etc., thereof.

Further, the above-described poor hardenability unfavorably renders the structure heterogeneous, due to the difference in the hardenability of the surface layer and of the central portion of the material, depending upon the size of the material.

If the lowering in the β transformation point or Ms point is intended to solve the above-described problems, the addition of substitutional alloying elements, such as V, Cr and Mo, to the titanium and α and (α+β) titanium alloys suffices for this purpose. The addition of the above-described elements, however, causes the composition of the material to become different from that intended, which renders this method unusable.

As apparent from the foregoing description, to date, a conventional process has not been found effective for the forming of a microstructure which is easy to work, and for converting the resultant microstructure into a fine acicular microstructure.

SUMMARY OF THE INVENTION

An object of the present invention is to provide a process for preparing titanium and α and (α+β) titanium alloy material products comprising a fine acicular microstructure having an excellent workability and fatigue properties, particularly a strong fracture toughness.

To attain the above-described object, the present invention has the following constitution.

The present inventors studied the effects of hydrogen, which can be easily incorporated in titanium and α and (α+β) titanium alloys and removed therefrom, and as a result, arrived at the following findings.

Specifically, when titanium and α and (α+β) titanium alloys are hydrogenated, hydrogen is dissolved in the material to lower the β transformation point. This enables the working in a β region having an excellent workability to be conducted at a temperature lower than that used in the prior art, and as a result, the coarsening of β grains in the β region can be suppressed. Further, since the hydrogenation improves the hardenability of the material, a fine acicular martensitic microstructure can be formed homogeneously from the surface to the central portion of the material, without conducting a special quenching in the cooling from the β region after hot working. A subsequent heating of the material in vacuum causes the material to be dehydrogenated, and at the same time, to have a homogeneously fine microstructure comprising an acicular microstructure, so that a material having an excellent fatigue strength, particularly an excellent fracture toughness, is obtained.

The present invention has been made based on such a novel finding, and is characterized by heating a titanium material or an α or (α+β) titanium alloy material hydrogenated in an amount of 0.02 to 2% by weight of point and below 1100° C., subjecting the heated material to hot working in said temperature range with a reduction of 30% or more, terminating said working in a β single phase temperature region, cooling the worked material to 400° C. or less, and annealing the cooled material in vacuum.

Further, the present invention is characterized by heating a titanium material or an $\alpha$ or $(\alpha+\beta)$ titanium alloy material hydrogenated in an amount of 0.02 to 2% by weight of hydrogen to a temperature above the $\beta$ transformation point and below 1100° C., cooling the heated material to 400° C. or lower, reheating the cooled material to a temperature above the $\beta$ transformation point and below 1100° C., subjecting the reheated material to hot working in said temperature range, terminating said working in a $\beta$ single phase temperature region, cooling the worked material to 400° C. or less, and annealing the cooled material in vacuum.

DESCRIPTION OF THE PREFERRED EMBODIMENTS

Figure 1:
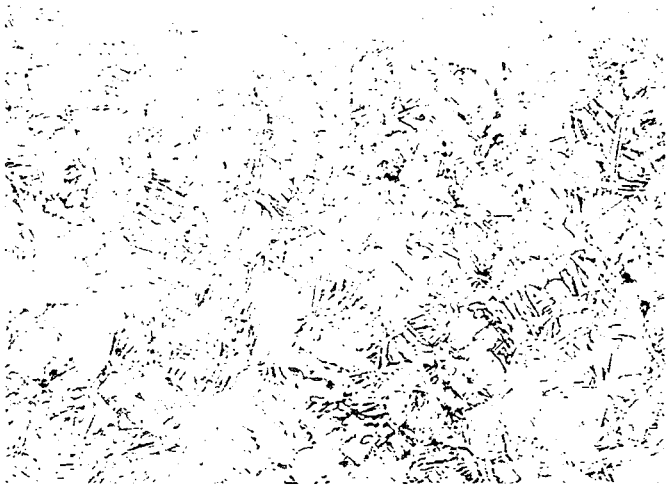
FIG. 1 is a microphotograph showing a microstructure of a material prepared according to the process of the present invention.

Examples of the object material of the present invention include commercial pure titanium such as the titanium specified in JIS (Japanese Industrial Standards), $\alpha$ titanium alloys such as Ti-5Al-2.5Sn, and $(\alpha+\beta)$ titanium alloys such as Ti-6Al-4V. Casting materials such as ingot, hot worked materials subjected to casting, blooming, hot rolling, hot extruding, etc., or cold worked materials, and further, powder compacts, etc., may be used as the material.

In the present invention, the above-described materials are hydrogenated in an amount of 0.02 to 2% by weight of hydrogen and treated. The hydrogenation may be conducted at the time of the melting of the materials. Alternatively, the hydrogen may be incorporated by such means as heating the materials in a hydrogen atmosphere. There is no particular limitation on the hydrogenation method.

When the hydrogenated material is heated to a temperature above the $\beta$ transformation point, the material composition is homogenized, due to its high diffusivity in the body-centered cubic structure. This hydrogenated material is hot-worked by methods such as rolling, extruding and forging. In this case, as described above, the dissolution of hydrogen in the material causes the temperature range necessary to form a $\beta$ single phase to be extended to the low temperature side, so that it becomes possible for the hot working in a $\beta$ region having an excellent workability to be conducted at a temperature lower than that used in the prior art. This enables the hot working to be conducted in a state such that not only is the coarsening of the $\beta$ phase suppressed but also the occurrence of surface defects and cracking is prevented.

Further, when the material is cooled from the $\beta$ region after the hot working, since the $\beta$ transformation point and Ms point are both low, a material comprising an acicular martensitic structure which is fine and homogeneous from the surface to the central portion of the material can be prepared through a suppression of the diffusion type transformation to an $(\alpha+\beta)$ and an improvement in the hardenability, without conducting a special quenching. Dense dislocations are introduced in the hydride per se and around the hydride through an application of a strain to the material and a precipitation of a hydride during or after cooling. When this material is annealed in vacuum, it is dehydrogenated. Further, at that time, in the acicular martensitic microstructure, a recrystallized $\alpha$ phase is formed from the dislocated portion, and an acicular microstructure is partially divided to form a homogeneous fine microstructure comprising an acicular microstructure, so that a material having an excellent fracture toughness and fatigue strength is prepared.

To obtain the above-described effect, it is necessary to make the hydrogen content 0.02% or more, lower the $\beta$ transformation point, conduct the hot working at a temperature above the $\beta$ transformation point, and then cool it to a temperature of 400° C. or lower. When the hydrogen content exceeds 2%, the material becomes fragile, which brings a possibility of a cracking of the material during handling. For this reason, the hydrogen content is limited to the above-described value. When the temperature for heating the material above the $\beta$ transformation point is too high, it is difficult to form an intended fine microstructure due to a coarsening of $\beta$ grains. Therefore, the upper limit of the heating temperature is limited to below 1100° C. With respect to cooling from the $\beta$ region after hot working, any of furnace cooling, air cooling and water quenching may be applied. The heating in vacuum in the next step should be conducted after cooling to 400° C. or lower. When the cooling is terminated above 400° C. and the material is then reheated, a sufficient martensitic transformation is not conducted, and thus an intended fine acicular structure can not be formed.

In the first invention of the present application, a hydrogenated material is heated to a temperature above the $\beta$ transformation point and then subjected to hot working. In this case, considering an inclusion of coarse grains in the microstructure of the material, the reduction was limited to 30% or more to refine the coarse grains.

In the second invention of the present application, a hydrogenated material is heated to a temperature above the $\beta$ transformation point, cooled to 400° C. or below, reheated above the $\beta$ transformation point, and hot-worked. In this case, the former step of heating and cooling is conducted while considering an inclusion of coarse grains in the microstructure of the material. Since the microstructure is refined by this heat treatment, the reduction in the hot working may be less than 30%, but preferably the hot is conducted with a reduction of 15% or more.

The cooling of the material from a temperature above the $\beta$ transformation point may be conducted in a wide range of from furnace cooling to water cooling. Therefore, even when the material has a large section, it is possible to form a homogeneously fine acicular martensitic structure through a selection of an optimal cooling condition.

After the completion of the hot working and cooling, the material is annealed in vacuum. In this case, the degree of vacuum may be a reduced pressure of about $1\times10^{-1}$ Torr or less for dehydrogation. The higher the vacuum, the shorter the heat treating time. Preferably, from the practical pont of view, the reduced pressure is about $1\times10^{-4}$ Torr. The treating time varies depending upon factors such as the thickness of the material. The thicker the material, the longer the treating time. Further, when the acicular microstructure is partially divided through recrystallization from a high-density dislocation network by the annealing, to form a homogeneously fine acicular microstructure, the recrystallized α phase should not be coarsened. For this reason, the treating temperature and the treating time are preferably 500°to 900° C. and 100 hr or less, respectively.

The effect of the present invention is exhibited when the β transformation point and Ms point have been lowered by hydrogenation. The proper hydrogen content varies depending upon the material composition of the object material. Therefore, to lower the β transformation point and Ms point, the proper hydrogen content is preferably 0.02% or more for JIS grade 2 pure titanium, 0.01% or more for Ti-5Al-2.5Sn and 0.02% or more for Ti-6Al-4V.

The material prepared by the process of the present invention comprising the above-described steps has a homogeneously fine acicular microstructure, and therefore, has excellent properties in respect of the fatigue strength thereof, due to the fine microstructure, and particularly, in fracture toughness due to the acicular microstructure.

As described above, in the prior art, the necessity of using a high temperature above the β transformation point in the working of a titanium material brought about a coarsening of the structure, so that it was very difficult to prepare a material having the above-described acicular microstructure. By contrast, in the present invention, the β transformation point is lowered through the hydrogenation of a titanium an material, thus successfully enabling the working to be conducted at a low temperature and a homogeneously fine acicular microstructure to be formed.

Therefore, the present invention is the first to prepare a titanium material having an excellent workability and fracture toughness.

EXAMPLE

Example 1

Billets of an (α+β) titanium alloy composed of Ti-6Al-4V were heated in a hydrogen atmosphere at 750° C. for 1 to 20 hr, to give them the various hydrogen contents shown in Table 1, and were then heated to various temperatures and subjected to hot extruding with a reduction of 60%, to prepare rods having a diameter of 60 mm, and cooled (air-cooled) to room temperature at a cooling rate of about 1.2° C./sec. The working termination temperature was substantially the same as the heating temperature. Thereafter, the materials were annealed in a vacuum of $1\times10^{-4}$ Torr at 700° C. for 5 hr.

The microstructure of the central portion of each material was observed, and as a result, it was found that, as shown in Table 1, with respect to materials respectively having hydrogen contents of 0.2%, 1.5% and 2.1%, an intended fine acicular microstructure was obtained when the materials were worked at 910° C. and 1000° C., respectively. When the hydrogen content was as low as 0.05%, the intended microstructure was not formed at any temperature. When the heating temperature was 750° C., i.e., below the β transformation point, an equiaxed grain microstructure was obtained because the working was conducted in an (α+β) phase region. Further, a coarse acicular microstructure was formed when the material was heated to 1100° C. and then worked. When the hydrogen content was 2.1%, surface cracking occurred during hot extruding.

Figure 2:
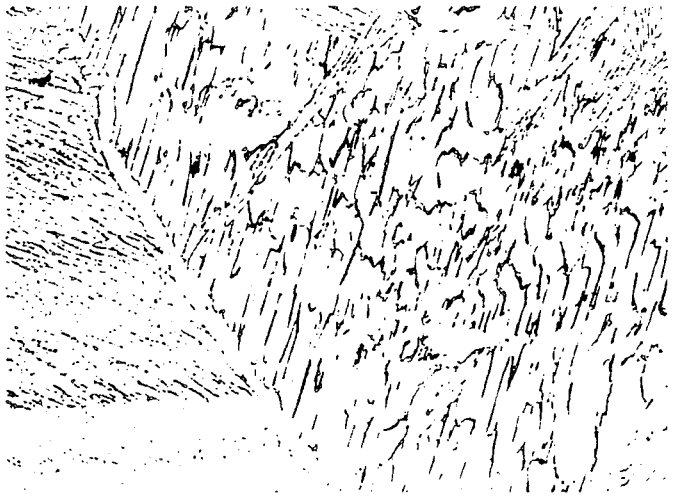
FIG. 2 is a microphotograph showing a microstructure of a material prepared in a comparative example.

FIG. 1 is a micrograph (×200) showing representative microstructure of the present invention, the central portion of sample No. 2 subjected to hot extruding at 910° C. and then annealing in vacuum, and FIG. 2 is a micrograph (×200) showing, as a comparative example having a coarse acicular microstructure, the central portion of sample No. 1 subjected to hot excluding at 1100° C. and then annealing in vacuum.

Sample No.2 (FIG. 1) and sample No. 1 (FIG. 2) each subjected to the above-described treatments were subjected to measurement of an impact value thereof at room temperature, and as a result, it was found that the impact values of sample No. 2 having a fine acicular microstructure and sample No. 1 having a coarse acicular microstructure were 4.8 kg.m/cm$^2$ and 3.2 kg.m./cm$^2$, respectively; i.e., sample No. 2 exhibited a higher value than sample No. 1.

Thus, according to the present invention, an (α+β) titanium alloy material having a homogeneously fine acicular microstructure can be stably prepared under a wide range of conditions.

TABLE 1

| Sample No. | Hydrogen content (wt. %) | Hot rolling temp. (°C.) 750 | 910 | 1000 | 1100 |
|---|---|---|---|---|---|
| 1 | 0.005 | equiaxed grain | coarse equiaxed | coarse acicular | coarse acicular |
| 2 | 0.2 | equiaxed grain | fine acicular | fine acicular | coarse acicular |
| 3 | 1.5 | equiaxed grain | fine acicular | fine acicular | coarse acicular |
| 4 | 2.1 | equiaxed grain | fine acicular | fine acicular | coarse acicular |

Example 2

Ingots of an (α+β) titanium alloy composed of Ti-6Al-4V hydrogenated in various amounts of hydrogen were are heated to a β single phase region of 1000° C., cooled (air-cooled) to room temperature at a cooling rate of about 1.5° C./sec, heated to various temperatures shown in Table 2, hot-rolled with a reduction of 40% to prepare plates having a thickness of 5 mm, and cooled (air-cooled) to room temperature at a cooling rate of about 2.0° C./sec. The working termination temperature was substantially the same as the heating temperature. Thereafter, the materials were annealed in vacuum of $1\times10^{-4}$ Torr at 700° C. for 5 hr.

The microstructure of the central portion of each material was observed, and a result, it was found that, as shown in Table 2, with respect to materials respectively having hydrogen contents of 0.2%, 1.5% and 2.1%, an intended fine acicular microstructure was obtained when the materials were hot rolled at 910° C. and 1000° C., respectively. When the hydrogen content was as low as 0.005%, the intended structure was not formed at any temperature. When the heating temperature was 750° C., i.e., below the β transformation point, an equiaxed microstructure was obtained because the hot rolling was conducted in an (α+β) phase region. Further, a coarse acicular microstructure was formed when the material was heated to 1100° C. and then hot rolled. When the hydrogen content was 2.1%, surface cracking occurred during hot rolling.

TABLE 2

| Hydrogen content (wt. %) | Hot rolling temp. (°C.) 750 | 910 | 1000 | 1100 |
|---|---|---|---|---|
| 0.005 | equiaxed grain | coarse equiaxed | coarse acicular | coarse acicular |

TABLE 2-continued

| Hydrogen content (wt. %) | Hot rolling temp. (°C.) 750 | 910 | 1000 | 1100 |
|---|---|---|---|---|
| 0.2 | equiaxed grain | fine acicular | fine acicular | coarse acicular |
| 1.5 | equiaxed grain | fine acicular | fine acicular | coarse acicular |
| 2.1 | equiaxed grain | fine acicular | fine acicular | coarse acicular |

Example 3

In the same method as that of Example 2, an $\alpha$ titanium alloy composed of Ti-5Al-2.5Sn was hydrogenated, heated to a $\beta$ single phase region of 1060° C., cooled (air-cooled) to a room temperature at a cooling rate of about 1.5° C./sec, heated to various temperatures shown in Table 3, hot-rolled with a reduction of 50% to prepare plates having a thickness of 4 mm and cooled to room temperature at a cooling rate of about 2.0° C./sec. Thereafter, the materials were annealed in vacuum of $1\times10^{-4}$ Torr at 730° C. for 6 hr.

The microstructure of the central portion of each material was observed, and as a result, it was found that, as shown in Table 3, with respect to materials respectively having hydrogen contents of 0.3%, 1.7% and 2.2%, an intended fine acicular microstructure was obtained when the materials were rolled at 960° C. and 1050° C., respectively. When the hydrogen content was as low as 0.005%, the intended structure was not formed at any temperature. When the heating temperature was 780° C., and 1050° C., respectively. When the hydrogen content was as low as 0.005%, then the heating temperature was 780° C., an equizxed grain microstructure was obtained becasue the hot rolling was conducted in an $(\alpha+\beta)$ two phase region. Further, a coarse acicular microstructure was formed when the material was heated to 1160° C. and then rolled. When the hydrogen content was 2.2%, surface cracking occurred during hot rolling.

TABLE 3

| Hydrogen content (wt. %) | Hot rolling temp. (°C.) 780 | 960 | 1050 | 1160 |
|---|---|---|---|---|
| 0.005 | equiaxed grain | coarse equiaxed | coarse acicular | coarse acicular |
| 0.3 | equiaxed grain | fine acicular | fine acicular | coarse acicular |
| 1.7 | equiaxed grain | fine acicular | fine acicular | coarse acicular |
| 2.2 | equiaxed grain | fine acicular | fine acicular | coarse acicular |

TABLE 3-continued

As described above, according to the process of the present invention, titanium and $(\alpha+\beta)$ titanium alloy materials having a homogeneously fine acicular microstructure unattainable in the prior art can be stably prepared on a commercial scale, and the resultant materials have an excellent fatigue strength, and particularly, a strong fracture toughness, which renders the present invention very useful from the viewpoint of industry.

What is claimed is:

1. A process for preparing titanium and titanium alloy materials having a fine acicular microstructure, which comprises heating a titanium material or an $\alpha$or $(\alpha+\beta)$ titanium alloy material hydrogenated in an amount of 0.02 to 2% by weight of hydrogen to a temperature above the $\beta$ transformation point and below 1100° C., subjecting the heated material to hot working in said temperature range with a reduction of at least 30%, terminating said working in a $\beta$ single phase temperature region, cooling the worked material to 400° C. or less, and annealing the cooled material in vacuum.

2. A process according to claim 1, wherein the annealing is conducted in vacuum to dehydrogenate the material.

3. A process according to claim 1, wherein the annealing is conducted under conditions of a degree of vacuum of $1\times10^{-1}$ Torr or less in terms of pressure, a temperature of 500°to 900° C. and a time of 100 hr or less.

4. A process for preparing titanium and titanium alloy materials having a fine acicular microstructure, which comprises heating a titanium a material or an $\alpha$ or $(\alpha+\beta)$ titanium alloy material hydrogenated in an amount of 0.02 to 2% by weight of hydrogen to a temperature above the $\beta$ transformation point and below 1100° C., cooling the heated material to less than 400° C., reheating the cooled material to a temperature range above the $\beta$ transformation point and below 1100° C., subjecting the reheated material to hot working in said temperature range, terminating said working in a $\beta$ single phase temperature region, cooling the worked material to less than 400° C., and annealing the cooled material in vacuum.

5. A process according to claim 4, wherein the annealing is conducted in vacuum to dehydrogenate the material.

6. A process according to claim 5, wherein the annealing is conducted under conditions of a degree of vacuum of $1\times10^{-1}$ Torr of less in terms of pressure, a temperature of 500°to 900° C. and a time of 100 hr or less.

* * * * *

UNITED STATES PATENT AND TRADEMARK OFFICE

CERTIFICATE OF CORRECTION

PATENT NO. : 5,125,986

DATED : June 30, 1992

INVENTOR(S) : Kinichi KIMURA, et al.

It is certified that error appears in the above-identified patent and that said Letters Patent is hereby corrected as shown below:

Column 2, line 64 and 65, between "weight of" at the end of line 64 and "point" at the beginning of line 65, insert --hydrogen to a temperature above the B transformation--.

Column 8, line 20, after "temperature" insert --range--.

Signed and Sealed this

Fourteenth Day of September, 1993

Bruce Lehman

*Attest:*

BRUCE LEHMAN

*Attesting Officer*

*Commissioner of Patents and Trademarks*